United States Patent [19]

Mikos

[11] 4,253,205

[45] Mar. 3, 1981

[54] SOFA-SLEEPER

[75] Inventor: Aloysius J. Mikos, Skokie, Ill.

[73] Assignee: Leggett & Platt, Incorporated, Carthage, Mo.

[21] Appl. No.: 24,029

[22] Filed: Mar. 26, 1979

[51] Int. Cl.[3] ..... A47C 17/14

[52] U.S. Cl. ..... 5/13; 5/29

[58] Field of Search ..... 5/13, 28, 29, 38; 297/68

[56] References Cited

U.S. PATENT DOCUMENTS

| | | | |
|---|---|---|---|
| Re. 26,671 | 9/1969 | Rogers | 5/13 |
| 1,809,859 | 6/1931 | Meves | 297/68 |
| 2,315,969 | 4/1943 | Krakauer | 5/13 |
| 2,329,503 | 9/1943 | Young | 5/13 |
| 3,298,041 | 1/1967 | Rogers | 5/13 |
| 3,321,777 | 5/1967 | Pokorny | 5/13 |
| 3,416,168 | 12/1968 | Pokorny | 5/13 |
| 3,747,135 | 7/1973 | Barabas | 5/13 |
| 3,984,853 | 10/1976 | Wong | 5/13 |
| 4,035,852 | 7/1977 | Cycowicz et al. | 5/13 |

*Primary Examiner*—Casmir A. Nunberg

*Attorney, Agent, or Firm*—Wood, Herron & Evans

[57] ABSTRACT

A sofa or davenport having a foldable bed frame adapted to provide a seat when used as a sofa and a forwardly extending unfolded bed frame when used as a bed. The foldable frame includes pivotally interconnected head, body, intermediate and foot sections and a linkage operable to automatically control extension and contraction of the supporting legs and to control folding and unfolding of the interconnected sections between a fully extended, unfolded position wherein the sections extend over the sofa storage cavity and front rail; and a retracted position wherein the body, intermediate and foot sections are disposed substantially entirely below the plane of the top surface of the front rail of the sofa and the head section is disposed behind the back rest cushion of the sofa. The foldable bed frame is mounted to the sofa and supported by forward and rear support levers, the forward lever being pivotally connected at its lower end to an anchor plate secured to the sofa side frame and the rear lever being pivotable and slidable at its base in a generally horizontal slot in the anchor plate as the bed frame is moved between its retracted and its extended positions. The mounting and support system provides for a more balanced bed and eliminates the requirement for strong lift springs to operate the sleeper. The linkage is also operable to fully retract the front legs supporting the foot section of the bed frame when the foot section is raised to a generally vertical position during the folding operation to eliminate the possibility of pinching of the operator's hand. The unit also eliminates forward shifting of the frame when in the folded position and nearing the fully retracted position and reduces the possibility of sheet or blanket pinching.

31 Claims, 12 Drawing Figures

10
12
14
16
18
22
24
26
28
30
32
34
36
38
40
42
44
46
48
50
51
52
53
54
56
58
70
72
74
76
78
80
82
84
86
87
88
92
100
110
112
114
116
118
120
122
124
126
128
130
132
134
136
138
140
142
144
146
148
150
152
154
156
158
160
162
164
166
168
170
172
174
176
178
179
180
181
182
184
186
188
189
190
192
193
194
196
200
202
204
206
208
210
212
214
216
218
220
222
224

SOFA-SLEEPER

BACKGROUND OF THE INVENTION

This invention relates to a combination sofa-sleeper bed and, more particularly, to a sofa of the type which includes a foldable bed having head, body, intermediate and foot sections which may be collapsed and hidden in the bottom of the sofa when the unit is used as a seating surface.

Foldable sofa-sleepers having pivotally interconnected head, body, intermediate and foot sections movable between a fully folded or retracted position within the sofa frame and an extended position wherein the sections extend out and over the front rail of the sofa are known to the art. In general, prior sofa-sleepers of this type have always presented a problem in that a relatively large lifting force is needed to extract the folded bed frame from within the sofa. That is, such prior sofa-sleepers have always required a substantial lifting and forward pulling force to raise the bed frame out from within the sofa until a counterbalance position is reached usually at the point where the main body section has been lifted over the front rail. This relatively large lifting force has made the sleeper unduly cumbersome and difficult to operate. Prior workers in the art have used strong tension springs to aid the operator in extracting the folded bed frame from within the sofa. Such springs however increase the cost and complexity of the unit. Others have modified the support fixture in an attempt to make lifting easier but in so doing have sacrificed lateral stability of the bed in its unfolded or sleeping position. Thus, the head end of the bed tends to sway from side to side in use.

It has therefore been one objective of this invention to provide an improved mechanism for controlling movement of the bed frame between its retracted and extended positions relative to the sofa with a minimum of effort without the necessity of displacing any portion of the sofa framework and without detracting from the lateral stability of the bed. It has been a further objective of this invention to provide a more balanced bed which does not require relatively strong lift springs to operate. These objectives have been accomplished and one aspect of this invention is predicated upon the discovery that a more balanced bed not requiring extremely strong lifting springs to operate may be achieved by a foldable bed frame supporting fixture wherein the forward support lever is pivotally connected at its lower end to a fixed pivot in an anchor plate mounted to the sofa and the rear support lever is slidable in a generally horizontal slot in the anchor plate from a rearwardmost position when the bed frame is folded within the sofa and a forwardmost position when the bed is fully extended to the sleeping position.

Another disadvantage of many prior art sofa-sleepers has been the problem of "forward shifting" of the sleeper. Forward shifting occurs when the bed frame is in the folded position and nearing the final position as a sofa. Forward shifting causes the bed frame to interfere with the front rail of the sofa. If the shifting is serious enough, it can prevent retraction of the folded bed frame into the sofa.

It has therefore been another objective of this invention to provide a sofa-sleeper fixture which eliminates the problem of forward shifting. This objective has been accomplished by pivotally connecting the upper end of both the front support lever and rear support lever assembly directly to the main body section of the foldable bed frame.

Still another objective of this invention has been to provide an improved linkage for controlling the extension and contraction of the supporting legs of the foot section when the bed is moved from its extended position to its folded position. That is, in many prior art sleepers, the foot section supporting legs do not fully contract when the foot section is folded to a position overlying the body section. Rather, the supporting legs remain slightly lifted with respect to the foot section angles until lifting and rearward thrusting of the frame is begun. At this time, the supporting legs move into engagement with the frame angles of the foot section. If the operator's hands are in the vicinity of the supporting legs, there is a possibility that they can be pinched between the legs and the frame as the bed is folded. This is particularly true where a cross support bar is used to join the legs to improve lateral stability since the cross support bar could be caused to close on the operator's hand in the area where the operator is normally inclined to lift the bed when moving it to its retracted position.

To this end, the sofa-sleeper of this invention incorporates a linkage operable to fully contract the foot section support legs against the bed frame angles by the time the foot section has been fully raised and before folding it over the main body section. Thus, the present invention eliminates the problem of leg lift by fully contracting the legs before the operator begins rearward movement of the bed frame toward the sofa.

Another objective of this invention has been to reduce or eliminate the problem of sheet or blanket pinching. Heretofore, it has been possible for the loose edges of sheets or blankets tucked between the mattress and the bed frame to become pinched between the abutting ends of the four interconnected sections when the bed frame is moved to its extended position thereby cutting the sheets or blankets due to pinching action of the abutting ends. The present invention greatly reduces or eliminates this problem by pivotally interconnecting the bed sections such that their facing ends do not abut in the extended position but rather are spaced one from another so sheets or blankets cannot become pinched therebetween.

In general, the sofa-sleeper fixture of this invention which accomplishes these objectives includes a four section foldable bed frame adapted to be folded into an upholstered stationary box-like sofa frame. The foldable bed frame includes pivotally interconnected head, body, intermediate and foot sections. The pivotally interconnected bed sections are supported in an extended bed position by a plurality of foldable legs and by forward and rear support levers pivotally connected at their upper ends directly to the main body section of the frame with the forward lever being pivotally connected at its lower end to a fixed pivot in an anchor plate secured to the sofa side frame and the rear support lever at its base being slidable within a generally horizontal slot within the anchor plate between a rearwardmost position when the bed is fully retracted and a forwardmost position when the bed is fully extended. Interconnected linkages are operable to automatically retract the legs into a folded position when the bed frame is folded into a sofa position. The legs supporting the foot section of the bed frame are extended and retracted by means of actuating arms, each connected at one end to the leg and at the other end to a bell crank pivotally connected to the intermediate section. This linkage is operable to automatically lock the foot support legs to the frame when the foot section is raised just past a vertical position prior to being folded over the body section and well prior to rearward movement of the partially folded sections toward the sofa.

A primary advantage of the combination sofa-sleeper of this application is its improved balance which eliminates the requirements for strong lift springs to aid in extracting the folded bed frame from within the sofa frame while at no sacrifice to the lateral stability of the bed. A further advantage of this invention is its adaptability to styles and shapes of upholstered sofa constructions which have different seating height surfaces or which have differing thicknesses of mattresses. This ability to accommodate different heights and different mattresses enables a single fixture to fit numerous styles and variations of sofa sleepers.

Further advantages of this sofa-sleeper reside in the comfort of its seating and sleeping surfaces and the elimination or at least substantial reduction of the tendency of the bed frame to pinch and cause tearing of sheets and blankets.

In its general aspect, the combination of this invention provides a better balanced sofa-sleeper which is easier to manufacture with less weight and at lower cost.

These and other objects and advantages of this invention will be more readily apparent from the following detailed description of the invention taken with the accompanying drawings.

DETAILED DESCRIPTION OF THE INVENTION

Figure 1:
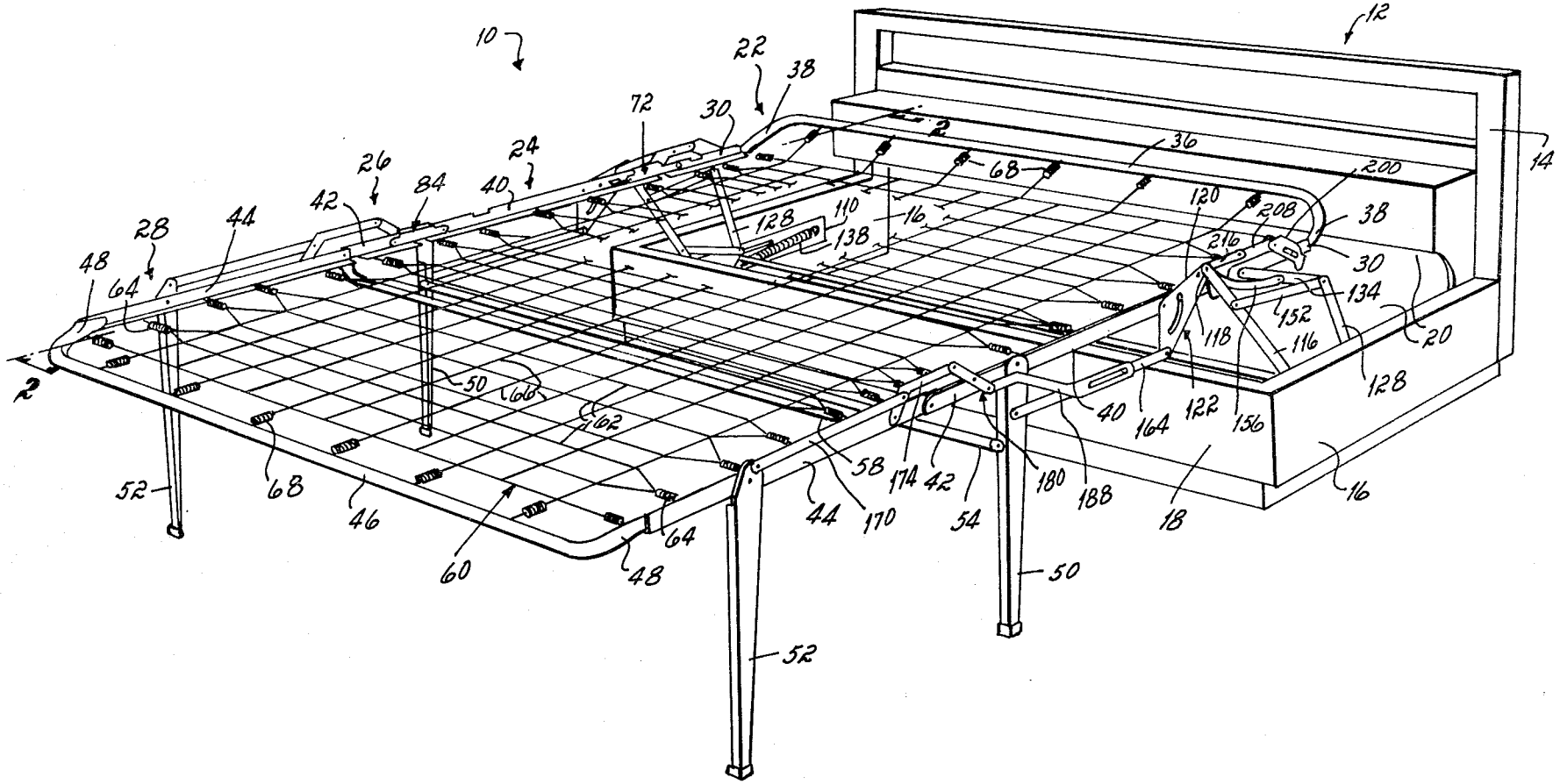
FIG. 1 is a perspective view of the foldable sofa-sleeper fixture embodying the invention of this application, the sleeper being shown in the extended bed position.
Figure 2:
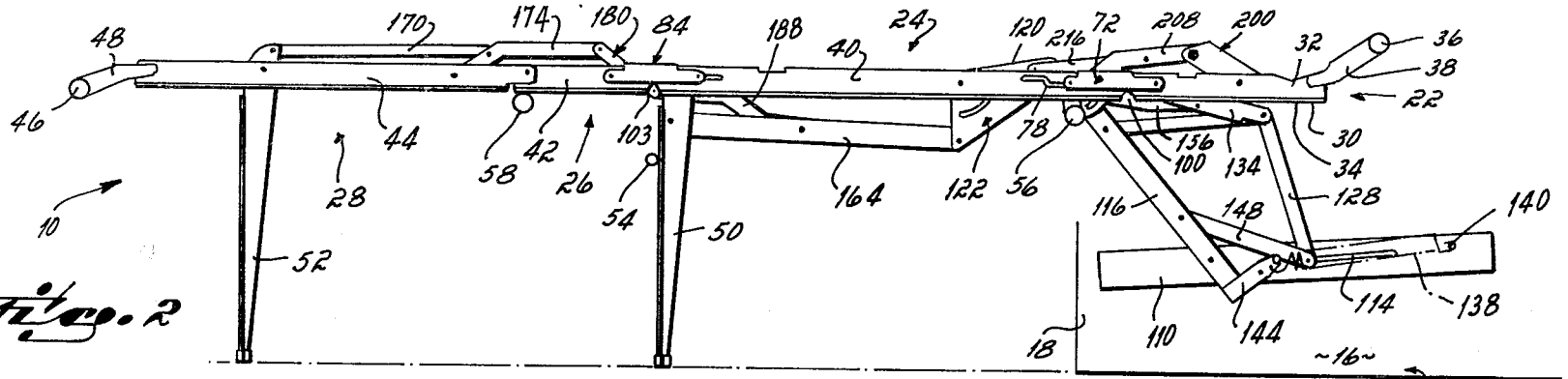
FIG. 2 is a side view taken along lines 2—2 of FIG. 1.

Referring now in detail to the drawings and particularly to FIGS. 1 and 2, it will be noted that the combination sofa-sleeper frame 10 is illustrated as being mounted upon a frame 12 of an upholstered sofa which has a back rest cushion 14, a pair of side rails 16, and a fixed front rail 18 which define a generally rectangular storage enclosure 20 for the folded bed frame 10. The sofa does not form any part of the invention of this application and may comprise any well known standard upholstered frame construction. As used herein, the terms "front" or "forward" end of the bed reference that direction which is away from the sofa while the terms "rear" or "rearward" refer to a direction which is toward the sofa 12.

The foldable sofa-sleeeper frame 10 comprises a rear head section 22, a long intermediate or main body supporting section 24 pivotally connected at one end to the head section 22, a short intermediate section 26 pivotally connected at one end to the other end of the long body section 24, and a front foot section 28 pivotally connected to the other end of the short intermediate section 26. The head section 22 comprises similar, symmetrically disposed left and right main angles 30 each having an outer vertical flange 32 extending up from an outer end of a lower inwardly extending horizontal flange 34. The rearward ends of the side angles 30 of the head section 22 are interconnected by cross member 36 which comprises a transverse tubular member bent at its ends to form arms 38 which are riveted to adjacent ends of the main angles 30.

The long intermediate or main body section 24, the short intermediate section 26, and the foot section 28 each comprise similar, symmetrically disposed left and right main angles 40, 42 and 44, respectively. A cross member 46 interconnects the forward ends of the foot section angles 44. The member 46 is similar to the cross member 36 and comprises a transverse tubular member bent at its ends to form arms 48 which are riveted to adjacent ends of the main angles 44. The long intermediate angles 40 serve to guide the folded frame 10 into the sofa enclosure 20 and therefore are sometimes referred to in the art as "pilot section" angles. For convenience of reference, angles 40 will be referred to hereinafter as pilot section angles 40.

The interconnected sections 22, 24, 26, 28 are supported in their extended position by a pair of foldable center support legs 50 pivotally connected at their upper end by rivets 51 to the forward ends of the pilot section angles 40 and a pair of foot sections supporting legs 52 pivotally connected at their upper end by rivets 53 to the foot section angles 44. A tubular cross member 54 interconnects the center legs 50 and is riveted at either end thereto to provide the legs 50 with lateral stability. In addition, tubular cross members 56 and 58 interconnect the rearward ends of the pilot section angles 40 and the forward ends of the intermediate section angles 42, respectively. The members 56 and 58 are preferably riveted to their respective angles. If desired, a stabilizing member may be secured between the front legs 52 at the lower ends.

Stretched between the side frame angles of the head, body, intermediate and foot sections of the frame is a continuous interconnected link fabric 60 or other means of conventional construction (FIG. 1). The transverse wires 62 of the link fabric are resiliently connected to the side frame angles of the head, body, intermediate and foot sections by coil springs 64. The longitudinally extending wires 66 of the link fabric 60 are connected to the end cross tubes 36 and 46 by coil springs 68.

The interconnected sections 22, 24, 26, 28 together form a rectangular frame with curved corners when the bed frame 10 is fully pulled out. As may be seen in FIGS. 1 and 2, the sections lie in co-planar relation, i.e., they all lie on the same horizontal plane, and provide a resilient planar surface for supporting a mattress (not shown).

The foldable frames on both sides of the bed are similar and are symmetrically disposed. Since the means which connect the longitudinal portions of the bed frame on the right and left facing sides of the bed are similar and symmetrically disposed only the connections on one side will be described. The side of the frame shown in FIGS. 2–7 and FIG. 9 is the left facing side of the bed which is the side on the left side of a person standing in front of the foot of the bed and looking toward the head end of the bed.

Figures 2A, 2B:
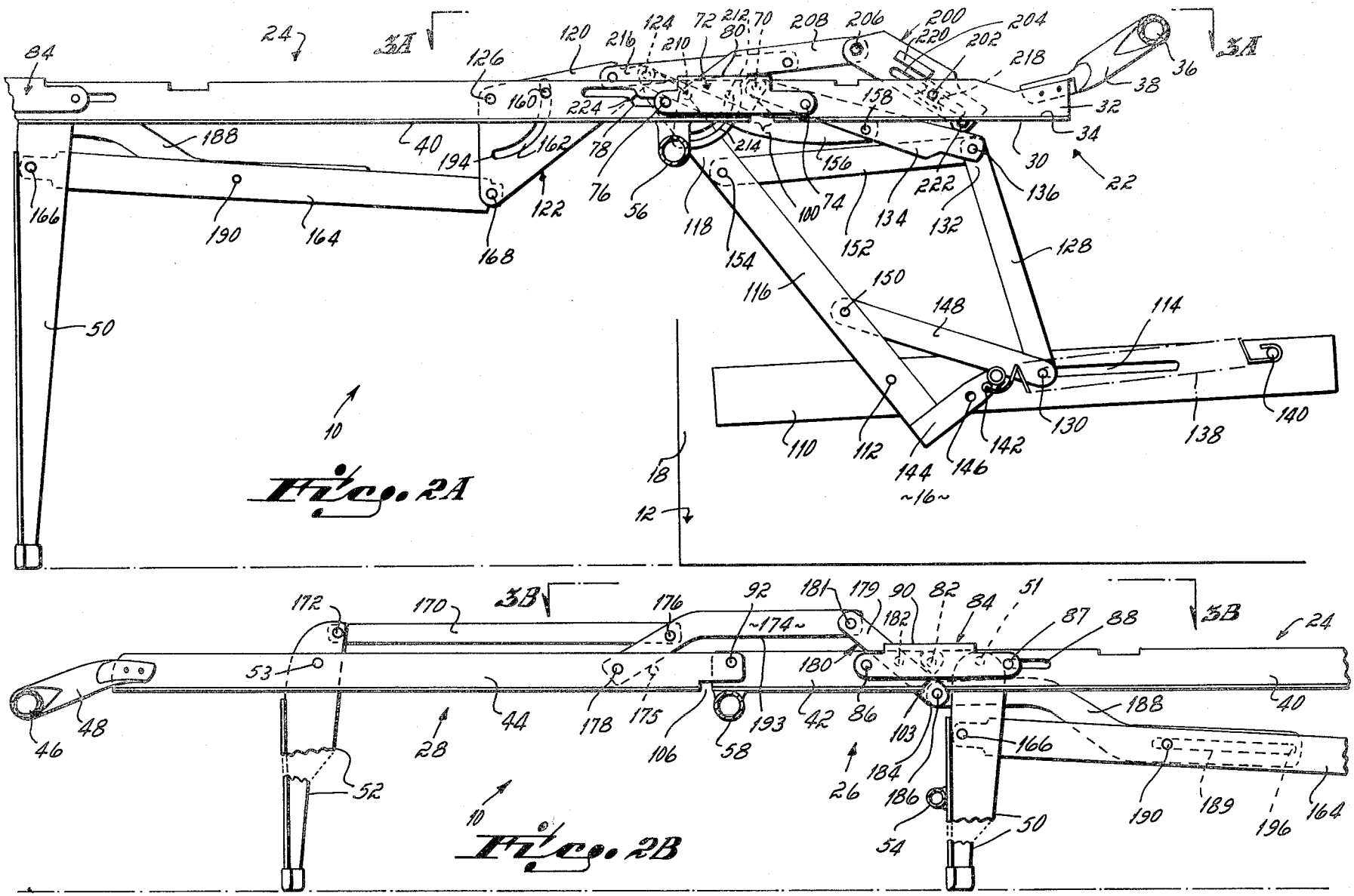
FIG. 2A is an enlargement of the rear half of FIG. 2 showing a side view of the head and main body sections.
FIG. 2B is an enlargement of the forward half of FIG. 2 showing the foot section, the short intermediate section and a forward position of the main body section.

The head section angle 30 is connected to the rearward end of the pilot section angle 40 by a rivet 70 and is cantilevered thereto by means of a locking strap 72 pivotally connected at 74 to the forward end of the head section angle 30, the opposite end of the strap 52 having a pin 76 slidable in a Z-shaped slot 78 in the rearward end of the pilot section angle 40. The strap 72 includes at its upper edge an outwardly extending horizontal flange 80 (FIG. 3A) which engages the upper edges of the head and pilot section angles 30 and 40, respectively, in the fully extended position to prevent downward movement of the head section 22 with respect to the main body section 24 past a point where the head section 22 is co-planar with the main body section 24 (FIGS. 2 and 2A).

Similarly, the forward end of the pilot section angle 40 is pivotally connected to the rearward end of the intermediate section angle 42 by a rivet 82. A second locking strap 84 having one end 86 pivotally connected to the intermediate section angle 42 and the other end making a pin 87 and slot connection 88 in the pilot section angle 40 is provided. The strap 84 has a like outwardly, horizontally extending flange 90 which engages the upper edges of the pilot section 40 and intermediate section 42 angles in the fully extended bed position (FIG. 3B) to assure that the intermediate section is co-planar with the main body section in the bed position (FIGS. 2 and 2B).

The foot section angle 44 is pivoted to the intermediate section angle by a rivet 92. No locking strap is used between these sections because the front support legs 52 provide the required support for a co-planar relation between sections 26 and 28, and a stud 175 protruding from the foot section angle 44 engages the arm 174 to level the foot section.

Figure 3A:
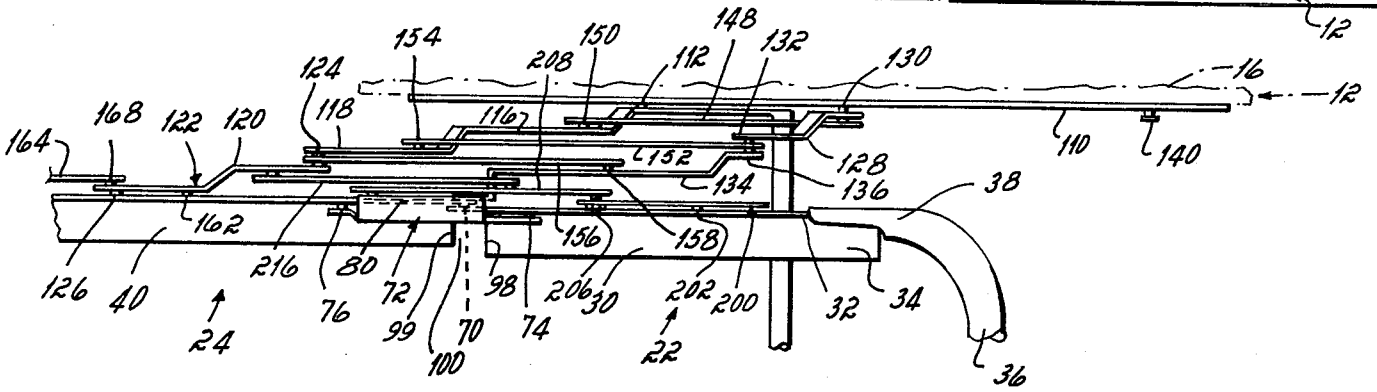
FIGS. 3A and 3B are top views of FIGS. 2A and 2B taken along lines 3A—3A and 3B—3B, respectively.
Figure 3B:
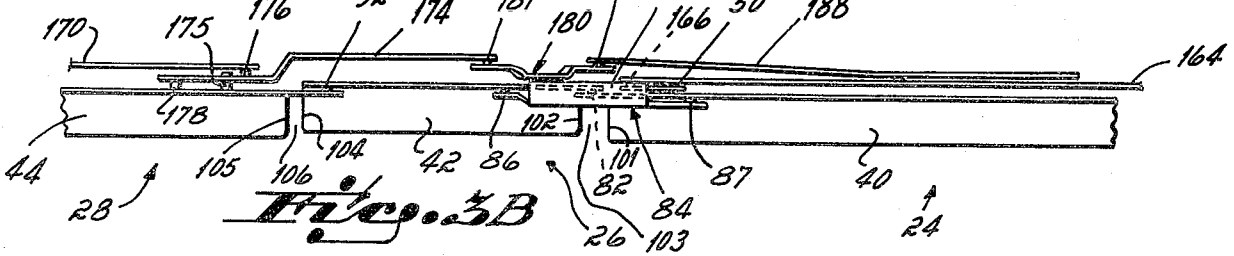

As may be seen particularly with reference to FIGS. 1 and 3A and 3B, the facing ends of the inwardly extending flange portions of the angles 30, 40, 42 and 44 forming the four sections 22, 24, 26 and 28, respectively, of the bed frame 10 are spaced one from another in the extended position of the bed frame 10. That is, the facing ends 98 and 99 of angles 30 and 40, respectively, are spaced one from another as at 100. The facing ends 101 and 102 of angles 40 and 42, respectively, are likewise spaced as at 103. And the facing ends 104 and 105 of angles 42 and 44 are similarly spaced as at 106. As may be seen, because the ends of the flanges are spaced, sheets or blankets cannot become pinched therebetween. Thus, the problem of pinching the loose edges of sheets or blankets, which are tucked under the mattress, between the articulated section as occurred in many prior art structures wherein the ends of the interconnected sections abut in the extended position has been eliminated by the foldable bed frame of the present invention.

In summary, the four section angles 30, 40, 42 and 44 are pivotally interconnected in end-to-end relation with the locking straps 72 and 84 and the legs 50 and 52 when unfolded cooperating to maintain the bed frame sections 22, 24, 26 and 28 in a co-planar horizontal position in the extended or sleeping configuration of the bed frame 10.

Referring specifically to FIGS. 2 and 2A, the foldable bed frame 10 is mounted and supported at its forward end with respect to the sofa 12 as follows. An anchor plate 110 is secured to the side rail 16 of the sofa frame 12 by suitable means such as bolts or screws (not shown). The anchor plate 110 includes a forward fixed pivot 112 and a slot 114 disposed rearwardly thereof in a generally horizontal orientation. A front support lever 116 is pivotally connected at its base with the fixed pivot 112 and its upper end 118 is pivotally connected to one arm 120 of a bed lock plate 122 by a single rivet 124. The bed lock plate 122 is in turn pivotally connected to the pilot section angle 40 by a single rivet 126. A rear support lever 128 has a pin 130 at its base making a sliding and pivoting connection with the slot 114 in the anchor plate 110. The upper end 132 of the rear support lever 128 is pivotally connected to one end of an upper rear support lever 134 by a single rivet 136. The opposite end of the upper rear support lever 134 is pivotally connected to the forwardmost end of the pilot section angle 40 by means of the pivot pin 70 interconnecting the pilot section angle 40 and the head section angle 30.

A coil tension spring 138 is fixed at its rearward end to the anchor plate 110 by a pin 140 protruding from the anchor plate, and its forward end passes through a hole 142 in an arm 144 riveted to the front support lever 116 at a point below the fixed pivot 112. The spring 138 biases the front support lever 116 to rotate in a counterclockwise direction about the pivot 112 (FIG. 2A). This tension spring 138 assists in the opening of the sofa-sleeper unit and holds the frame 10 in a partially opened counterbalanced position.

A second hole 146 is provided in the arm 144 attached to the base of the front support lever 116 to provide an alternate position for attaching the coil spring to the arm 144. This permits different tensions to be placed on the spring in the fully extended or sleeping position of the bed to accommodate mattresses having different compressibilities. For example, when a coil spring mattress is used, the spring may be placed in the forward hole 146 whereas when a lighter, more compressible foam mattress is used, the rear hole 142 could be used.

The front support lever 116 and rear support lever assembly 128, 134 serve to lift the pilot section angle 40 out of the enclosure 20 in the sofa 12 to project it and thus the sections 42 and 44 articulated to it forwardly over the front rail 18. In the fully extended position shown in FIG. 2 and the partially folded position shown in FIG. 5, the rear or head end of the pilot section angle 40 is supported by these levers.

To control the movement of support levers 116, 128 and 134, a guide link 148 is pivotally connected at its forward end, as by a rivet 150, to the front support lever 116 at a point above the pivot 112 and at its rear end to the base of the rear support lever 128 by means of the pin 130 sliding in the slot 114 in the anchor plate 110. The guide link 148 causes sliding movement of the pin 130 in the slot 114 and, consequently, forward and rearward movement of the rear support lever 128 on rotation of the front support lever 116 about the pivot point 112.

The upper end 132 of the rear support lever 128 is connected to the front support lever 116 by a control link 152 which is pivotally connected at its forward end to the front lever 116 by means of a rivet 154. At its rearward end, the control link 152 is interposed between the upper end 132 of the rear support lever 128 and the lower end of the upper rear support lever 134. It is pivotally connected to both members 128 and 134 by the rivet 136. The control link 152 causes the rear support lever 128 to pivot about pin 130 as the front support lever 116 pivots about pivot point 112 and controls the position of the pivot 136 in folding and unfolding of the unit.

An actuating arm 156 is pivoted at its forward end on rivet 124 and is attached to the arm 120 of the bed lock plate 122 between the arm 120 and the upper end 118 of the front support lever 116. At its rearward end, it is pivoted to the upper rear support lever 134 by means of a rivet 158. The actuating arm 156 controls movement of the upper rear support lever 134 and positions the sofa-sleeper unit during folding and unfolding.

The actuating arm 156 is pivotally connected at its forward end to both the upper end 118 of the front support lever 116 and the arm 120 of the bed lock plate 122 by the single rivet 124. The bed lock plate 122 is in turn pivotally connected to the pilot section angle 40 by the pivotal connector or rivet 126. There is also a pin 160 which protrudes on the pilot section angle 40 of the bed frame 10 and through an arcuate slot 162 of the bed lock plate 122. This latter pin or rivet 160 limits the rotational movement of the bed lock plate 122 at an angle of approximately 105°.

As stated above, when extended into a bed position, the frame 10 is supported by the pair of foldable center legs 50 and the pair of foldable front legs 52. The center leg 50 is pivotally attached at its upper end (pivot 51) to the forwardmost end of the pilot section angle 40 and similarly the front leg 52 is pivotally attached (pivot 53) at its upper end to the foot section angle 44. When unfolded, these legs support the center and forwardmost ends of the frame in an unfolded or bed position.

To control folding of the center legs 50, a center leg actuating arm 164 is pivotally connected at its forward end, as by a rivet 166, to the center leg 50 and at its rear end to the bed lock plate 122. The connection between the bed lock plate 122 and the center actuating arm 164 is preferably by a rivet 168.

Figure 5:
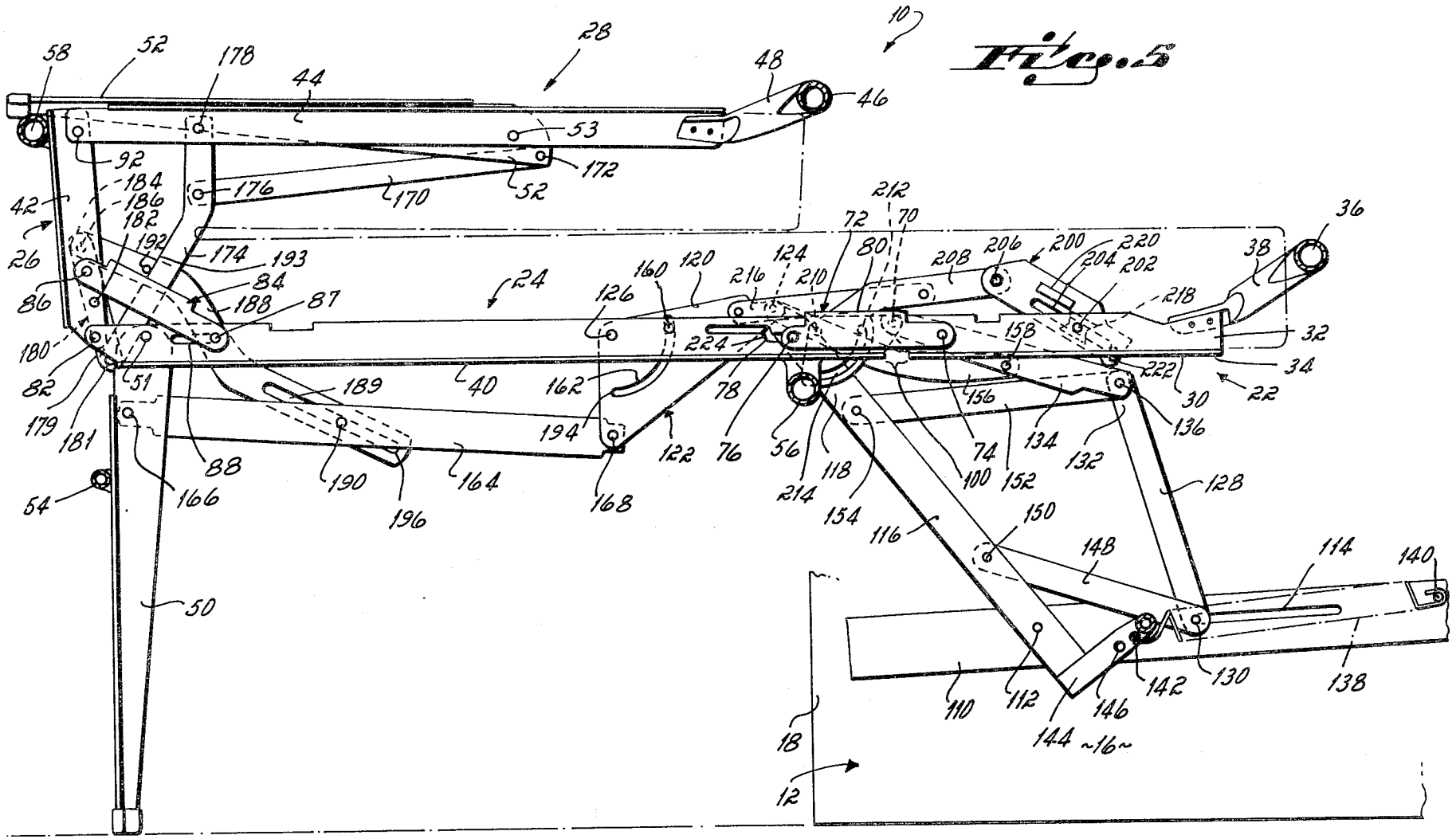
FIG. 5 is a side elevational view of the sofa-sleeper of FIG. 1 but with the foot section folded into overlying relation with the body section and illustrating the second step in folding the frame to a sofa position.
Figure 6:
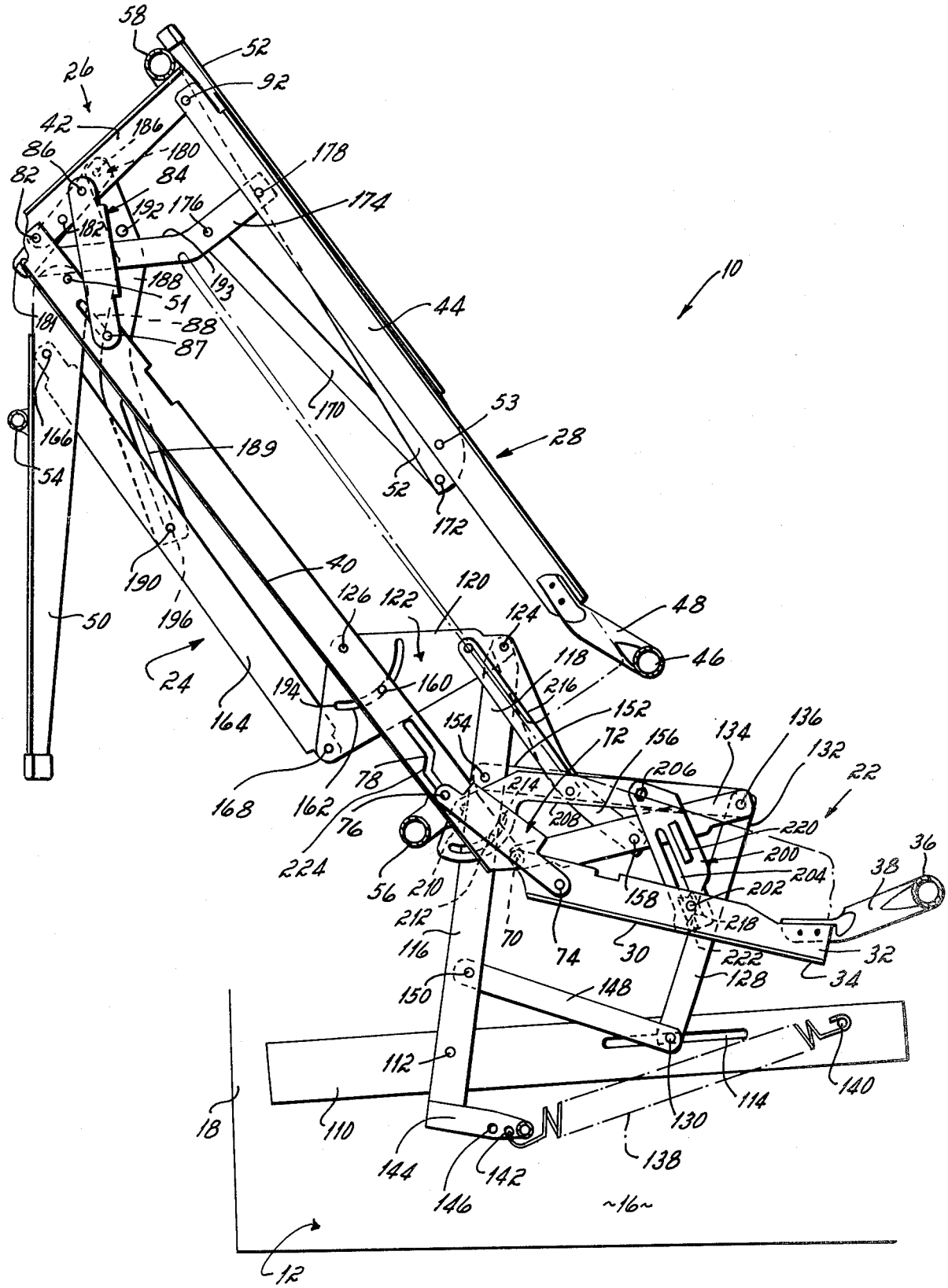
FIG. 6 is a side elevational view of the sofa-sleeper of FIG. 1 illustrating the next step in folding the frame to a sofa position.
Figure 7:
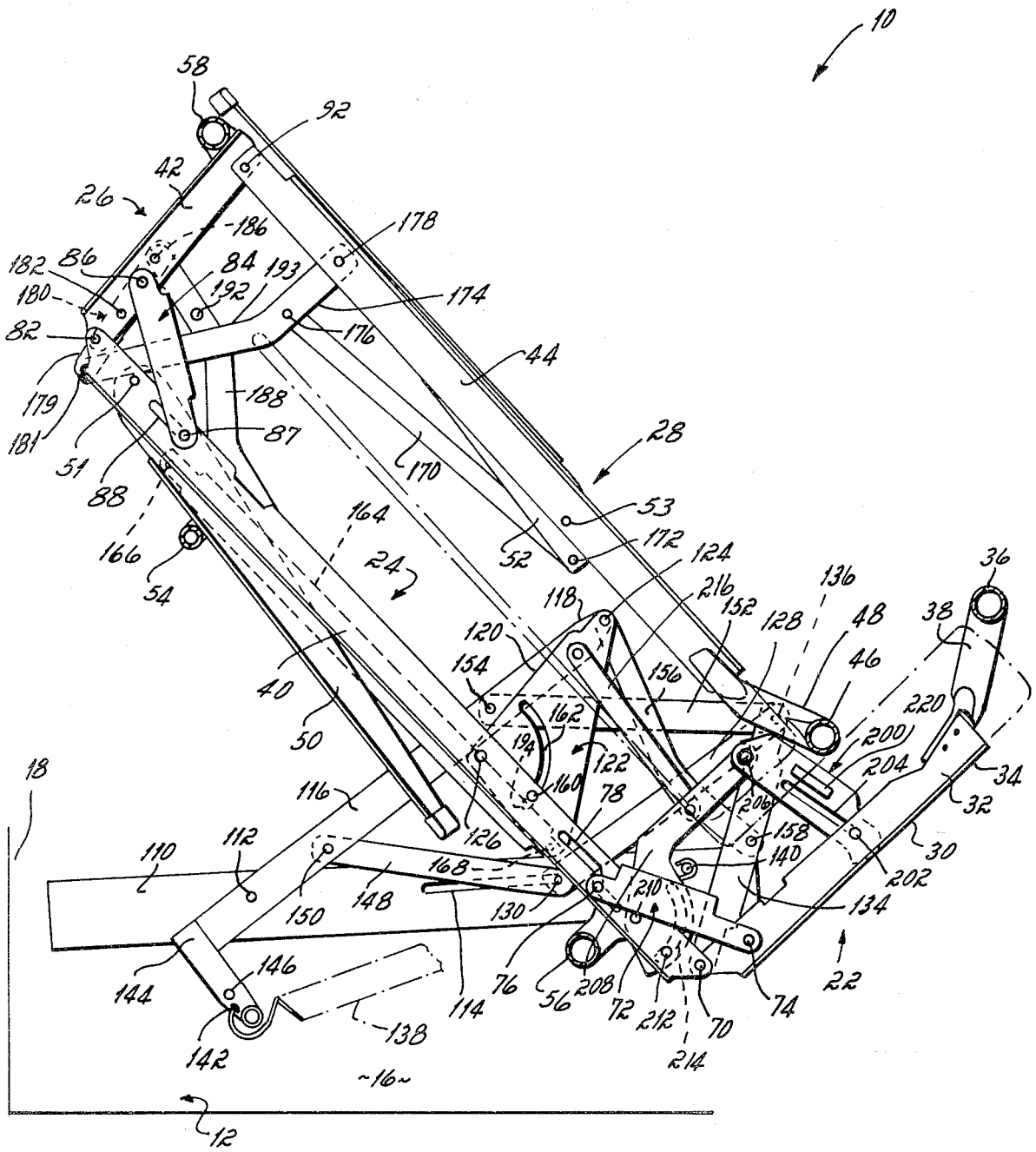
FIG. 7 is a side elevational view of the sofa-sleeper of FIG. 1 illustrating the final step in folding the frame to a sofa position.

As may be seen in FIGS. 5, 6 and 7, the center leg actuating arm 164 causes the center leg 50 to fold up under the pilot section angle 40 of the frame when the unit is collapsed from a bed to a sofa condition, and similarly the arm 164 causes the leg to be extended to a position normal to the body's pilot section angle 40 when the frame is unfolded to a sofa or bed condition. As set forth above, the legs 50 of the frame 10 are preferably interconnected by a cross brace 54.

To collapse the front leg 52 from a vertical position to a position in which it is generally parallel to the foot section angle 44 of the frame 10, an actuating arm 170 is pivotally connected at one end to the top of the leg as at 172 and is pivotally connected to a bell crank actuating arm 174 as at 176. The bell crank actuating arm 174 in turn is pivotally connected at its forward end to the foot section angle 44 as at 178 and at its rearward end to one arm 179 of a bell crank 180 as at 181. The bell crank 180 is pivotally connected to the rearward end of the intermediate section angle 42 by means of a rivet 182 (FIG. 3B). The opposite arm 184, which lies 180° from the arm 179, is pivotally connected as at 186 to a compression arm 188. The opposite end of the compression arm has a slot 189 in which a pin 190 protruding outwardly from the center leg actuating arm 164 slides making a lost motion connection. The compression arm 188 includes a stud 192 which protrudes inwardly from the arm 188. This stud 192 engages the underside edge 193 of the bell crank actuating arm 174 when the foot section overlies the main body section (FIG. 5) to prevent further rotation of the bell crank 180 in a clockwise direction.

Figure 4:
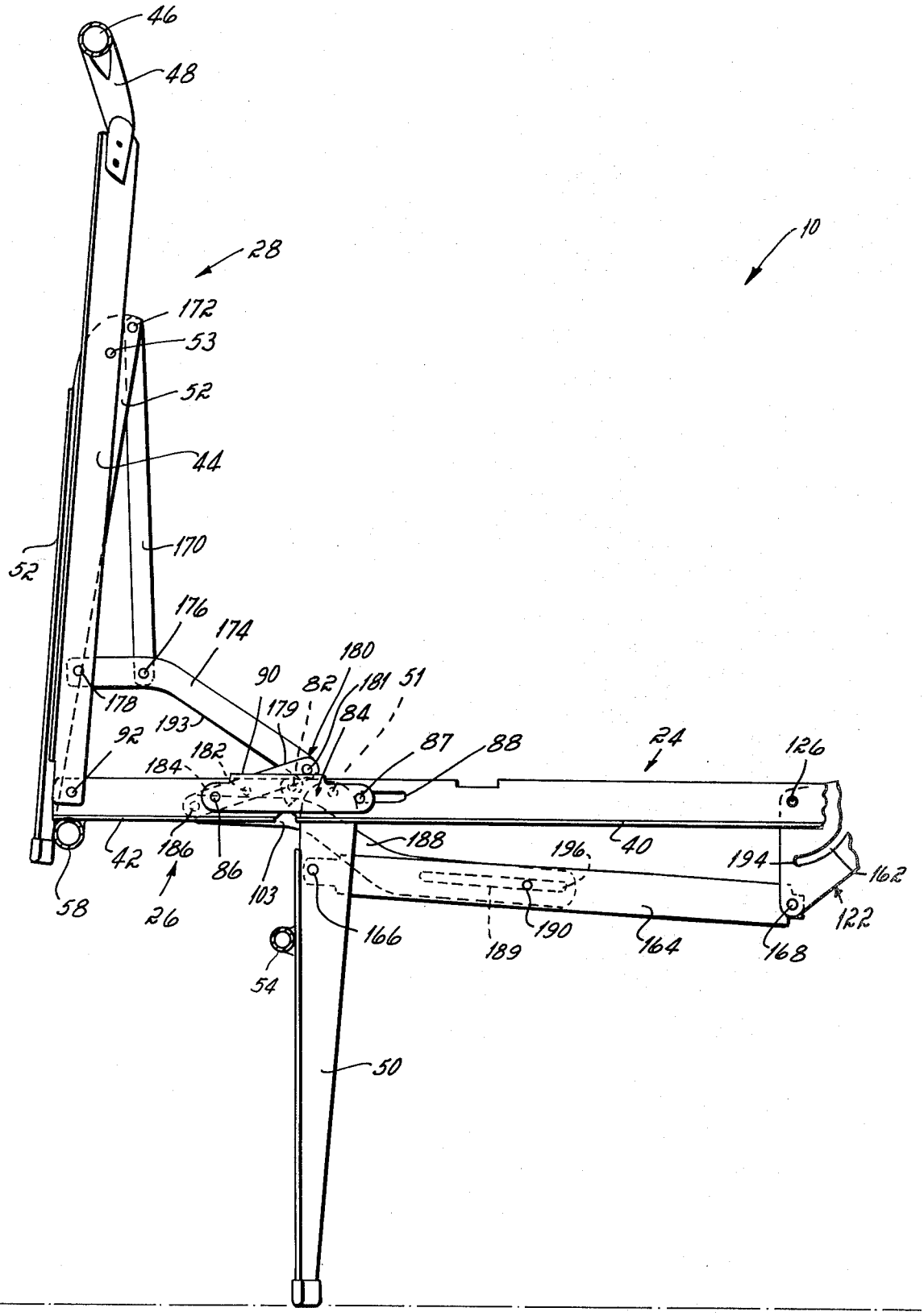
FIG. 4 is a side elevational view of a front portion of the sofa-sleeper of FIG. 1 but with the foot section partially folded.

As may best be seen in FIGS. 2 and 4, lifting of the foot section 28 of the frame 10 from a horizontal to a vertical position automatically causes the front leg 52 to be collapsed into a position in which it is substantially parallel to the foot section angle 44 and, similarly lowering the foot section automatically extends the leg 52 beneath the frame 10.

When the sofa-sleeper is fully extended, the foot section 28 of the frame 10 lies in a horizontal position supported by the leg 52. In this position, a stud 175 protruding outwardly from the foot section angle 44 engages the underside of the bell crank actuating arm 174 (FIGS. 2B and 3B). This prevents the pivot point 92 from moving upwardly to prevent "jackknifing" of the two sections as could otherwise occur if someone were to sit on the extreme forward end of the foot section 28.

Movement of the foot section 28 into overlying relation with respect to the main body section 24 causes pivoting of the intermediate section 26 with respect to the pilot section angle 40 about pivot point 82. Pivoting continues until the pin 87 in the rearward end of the locking strap 84 reaches the rearward end of the slot 88 (FIG. 5). At the point the pin 87 of the locking strap 84 engages the rear end of the slot 88 preventing any further rotational movement of the intermediate section 26 about the pivot 82, the intermediate section 82 of the frame has reached a position in which it is approximately perpendicular to the body section 24 and the foot section 28.

Figure 9:
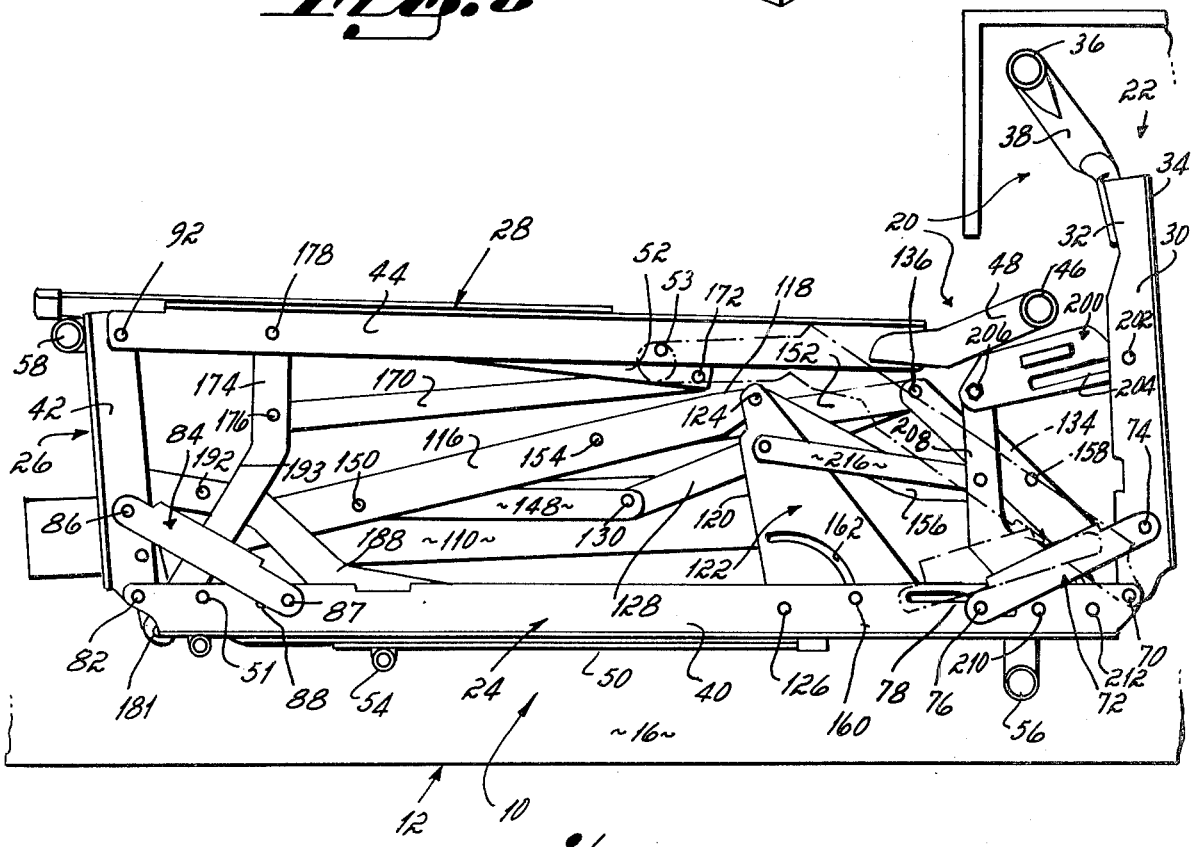
FIG. 9 is a view taken along line 9—9 of FIG. 8.

This same linkage, including the bell crank actuating arm 174, the bell crank 180 and the compression arm 188 also serve to lock the foot section 28, the intermediate section 26 and the body section 24 of the frame in the fully collapsed condition when the frame is completely folded into a sofa position. To this end, it will be noted in FIGS. 5–7, that as the frame moves from the position illustrated in FIG. 5 to that illustrated in FIG. 7, the bed lock plate 122 rotates in a counterclockwise direction as viewed in these figures until the pin 160 engages the lowermost end 194 of the slot 162. This rotational movement of the bed lock plate 122 causes the center leg actuating arm 164 to be moved downwardly and rearwardly until the pin 190 protruding therefrom engages the rearward end 196 of the slot 189. At this point (FIG. 6), the foot section 28 cannot be raised since counterclockwise rotation of the bell crank 180 is prevented by the compression arm 188. In this position, a folded mattress (shown in phantom in FIG. 5) between the foot section 28 and the body section 24 is fully compressed therebetween. In this locked condition, the mattress between the two sections 24 and 28 of the frame 10 forms a rearwardly sloping seat for the sofa and one which does not collapse or give when a person sits down upon it (FIG. 9). Moreover, in this locked compressed condition, the resiliency of the mattress will be prevented from raising the seat (foot section) upwardly when a person gets up from his seat on the sofa.

The head section 22 of the frame 10 has the capability of being raised to a locked, inclined position relative to the body section 24 to form an upper back and head rest for watching TV, reading and the like.

This capability is achieved by providing a TV slotted link 200 which is pivotally connected to the head section angle by means of a pin 202 slidable in a slot 204 in the slotted link 200. The other end of the slotted link 200 is connected by means of a pin 206 to the rearward end of a TV support link 208. The opposite end of the TV support link 208 is pivotally connected to the pilot section angle 40 by means of a pin 210. A second pin 212 protrudes outwardly from the pilot section angle 40 and moves in an arcuate slot 214 in the forward end of the TV support link 208. A TV control link 216 is pivoted at its rear end to the TV support link 208 and at its forward end to the arm 120 of the bed lock plate 122. A butterfly member 218 is pivotally mounted on the pin 172 between the outside of the head section angle 30 and the inside of the TV slotted link 200. The TV slotted link 200 further includes a lug 220 engageable with the butterfly member 218 to lock the head section 22 in an inclined position with respect to the body section 24 and an actuating lug 222 for moving the butterfly into and out of latching relationship with the lug 220. The operation of the butterfly 218 and lugs 220 and 222 is conventional and need not be described in detail. Briefly, the operation is sequential in that to move the head section 22 to the inclined TV position the operator first grasps the cross member 36 to rotate the head section 22 toward the body section 24. On rotation, the lug 220 first rotates the butterfly 218 into position for actuation by the lug 222. The head section is then pulled back slightly. The actuating lug 222 now rotates the butterfly for latching with the lug 220. To release the head section, it is again pulled forwardly whereby the lug 222 again rotates the butterfly member 218 out of position for latching engagement with lug 220. The head section may now be dropped to a horizontal position. In so doing, the lug 220 rotates the butterfly 218 into proper orientation for the subsequent raising and latching sequence.

The shoulder 224 in the Z-shaped slot 78 prevents the pin 76 and consequently the head section 22 from sliding forwardly in the position shown in FIG. 7 which otherwise could permit undesired rotation of the butterfly 218 and thus improper sequencing of the butterfly when operated without a mattress providing the resiliency to hold the head section in place.

In one presently preferred form of the invention, the connection of the forward end of the TV slotted link 200 to the rearward end of the TV support link 208 at 206 is not made until the bed frame 10 is assembled into the sofa frame 12. This permits the head section 22 to be interposed between the body section 24 and the foot section 28 in the fully folded position of the frame 10 to form a more compact package for shipping (shown in phantom in FIG. 9). During manufacture of the sofa-sleeper, the manufacturer installs a rivet 206 to connect the TV slotted link with the support link 208.

OPERATION

The folding sequence in which the frame 10 converts from a bed as illustrated in FIGS. 1 and 2 to a sofa is illustrated in FIGS. 4–9.

Referring first to FIGS. 2 and 4, it will be seen that the first step in the folding of the bed is to lift the front tubular cross member 46 until the foot section 28 of the frame is located in a position just past a vertical plane (FIG. 4). As a consequence of this movement, the front leg 52 is caused by the actuating arm 170 to fold to the foot section angles 44.

Continued pushing against the cross member 58 causes the frame to pivot about the pivot point 82 connecting the intermediate and pilot section angles 42 and 40, respectively, thereby lifting the intermediate section 26 of the frame into a vertical condition (FIG. 5). In the vertical condition of the intermediate section 26 of the frame, the forward end of the mattress is completely folded over upon itself to a double thickness as shown in phantom in FIG. 5. When the intermediate section 26 of the frame reaches the vertical position, the foot section 28 is then located in a horizontal plane over the top of the double thickness mattress. The intermediate section 26 is precluded against continued rotational movement about the pivot 82 by the pin 87 engaging the rear end of the slot 88.

Continued folding movement of the frame is then effected by lifting the tubular member 58 upwardly so as to lift what is now the front of the partially folded frame including the center leg 50 upwardly as illustrated in FIG. 6. At the time the operator grasps the member 58 to lift the partially folded bed frame, the front legs 52 have been fully collapsed into engagement with the foot section angles 44. Thus, there is no possibility of the operator's hands when grasping the tube 58 in the vicinity of the legs 52 of being pinched between the legs 52 and the angles 44. The upward movement of the front of the frame causes the front support lever 116 to rotate about its lower pivot 112; and, simultaneously, the bed lock plate 122 to rotate in a counterclockwise direction as viewed in FIG. 6. Simultaneously with the counterclockwise rotation of the bed lock plate 122, the center leg actuating arm is moved rearwardly completely collapsing the center legs 50 beneath the body section 24 of the frame.

In addition, the pin 190 protruding from the center leg actuating arm 164 reaches the rearward end 196 of slot 189 thereby pulling the compression arm 188 in a rearward direction. Compression arm 188 pivots the bell crank 180 about its pivot point 182 until the pin 190 engages the end 196 of the slot 191. This locks the foot section 28 in fixed relation to the body section 24 to prevent the resiliency of the mattress from pushing the foot section upwardly, as described above.

Simutaneously with the lifting of the front of the partially collapsed frame, the rear end of the pilot section angle 40 is lowered and moved to a rearward position as illustrated in FIG. 6. Rotation of the bed lock plate 122 causes the TV control link 216 acting through the TV support link 208 to pull the TV slotted link 200 in an upward and forward direction. This action pulls the head section 22 into an inclined position with respect to the body section 24 preparatory to the head section of the frame being moved up into a cavity in the back rest cushion 14. On further movement of the folded frame, the head section continues to rotate until the pin 212 engages the end of slot 214 in the TV support link. At this point, the head section 22 is perpendicular to the body section 24 (FIG. 7).

As may be seen in FIG. 6, rotation of the bed lock plate 122 and the front support lever 112 have caused the rear support lever 116 to move rearwardly (the pin 130 sliding rearwardly in the slot 114) and to pivot about pin 130 in a clockwise direction. After the frame has reached the position in FIG. 6, pushing against the front tube 58 causes the pin 130 to continue to move rearwardly in the slot 114 until it contacts the rearward end of the slot 114. Movement of the control link 152 in response to pivotal movement of the front support lever 116 also causes the rear support lever 128 to pivot rearwardly. In this orientation, the bed lock plate 122 has rotated the full counterclockwise distance permitted by the pin 160 moving in the arcuate slot 162 to retract the legs 50. In the course of this movement, the head section 22 is caused to move from its generally horizontal to its vertical position about the pivot point 70. When the head section 22 finally reaches the vertical position, it is located completely within a cavity contained within the back rest of the sofa.

Figure 8:
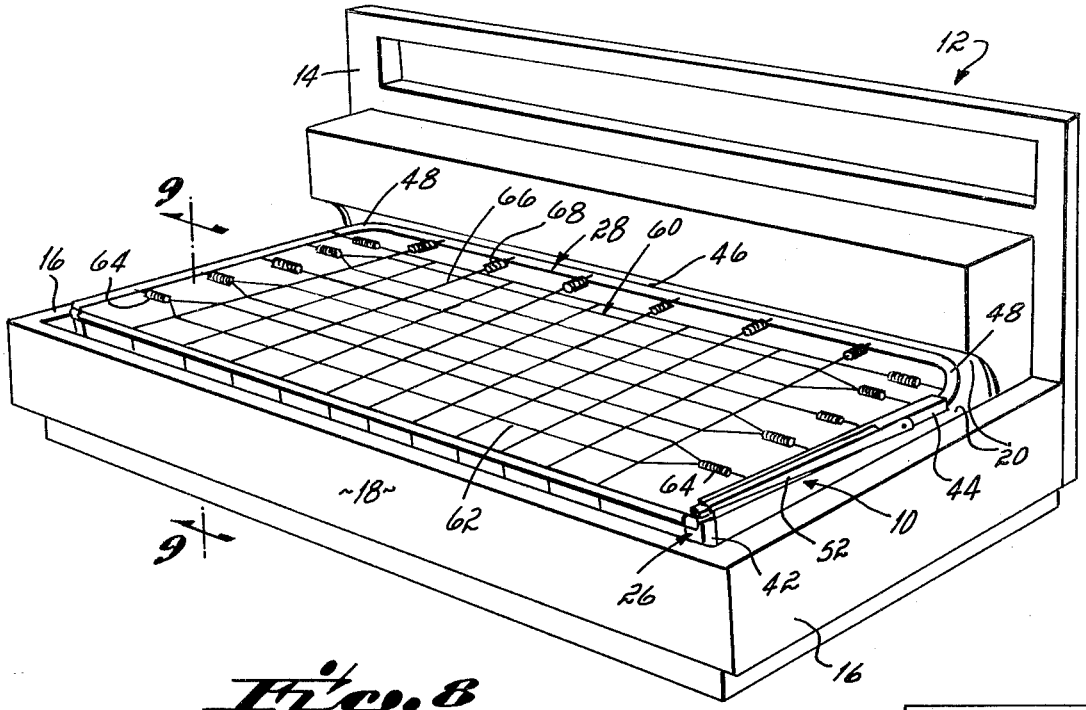
FIG. 8 is a perspective view showing the frame in its completely folded sofa position.

Referring now to FIGS. 8 and 9, it will be seen that in the collapsed or folded sofa position, the main body section 24 lies in a horizontal plane at the bottom of the sofa frame with the foot section 28 overlying it and forming the seat of the sofa. The intermediate section 26 is in a vertical orientation behind the front rail 18. The head section 22 is in a vertical position behind the back 14 of the sofa.

To extract the folded bed frame from the storage enclosure 20 to form an unfolded bed, the procedure described above is reversed. Briefly, the operator grasps the tubular member 56 and pulls the folded frame upwardly and outwardly over the front rail 18. The tension spring 138 which in the collapsed position is in tension serves to aid counterclockwise rotation of the front support lever 116 about the pivot point 112 to assist in lifting the frame. The guide link 148 and control link 152 cause forward movement of the pin 130 in the slot 114 as well as counterclockwise rotation of the rear support lever 128 about the pin 130. Simultaneously, the bed lock plate is caused to rotate in a clockwise direction by the actuating arm 156 and front support lever 116 thereby extending the center legs 50 by means of the center leg actuating arm 164. The position shown in FIG. 6 is generally a counterbalanced position. The body section is then permitted to drop toward the floor with the center leg 50 being fully extended to support the partially folded frame in that position shown in FIG. 5. The operator then grasps the front tubular member 58 to rotate the intermediate section forwardly about pivot 82. When the lock 84 engages the pilot section angle 40 and intermediate section angle 42 further movement of the tube 58 causes the bell crank 180 to rotate in a counterclockwise direction extending the front leg 52 through the bell crank actuating arm 174 and front leg actuating arm 170. Front leg 52 pivots around rivet 53 until fully extended. At this point, the leg is in a vertical disposition with the foot section being disposed horizontally. The four sections thus are unfolded to form a horizontal sleeping surface.

Although my invention has been described in terms of certain preferred embodiments, it will be recognized that other forms may be adopted within the scope of my invention.

I claim:

1. A foldable sofa-sleeper bed frame adapted to be mounted upon a sofa frame having back and side members and a stationary front rail which define a rectangular storage enclosure, said bed frame comprising a plurality of pivotally interconnected head, body, intermediate and foot sections, said bed frame sections each including a pair of opposed side rails, and a fixture supporting said bed frame for movement between: (1) a retracted position in which the bed frame is contained within said storage enclosure behind said front rail substantially entirely below the plane of the top surface of said front rail to form a sofa seat, and (2) an extended position in which said bed frame lies above and extends forwardly over said front rail to form a bed, said support fixture comprising:

support means affixable to the side frame members of said sofa and having a front fixed pivot and rearwardly thereof a movable pivot, front support lever means pivotally connected between said front fixed pivot and said bed frame, rear support lever means pivotally connected between said movable pivot and said bed frame, and control link means pivotally connected between said front and rear support lever means operable to control the movement of said rear support lever means as said bed frame is moved between its extended position and its retracted position, said front and rear support lever means being operable to support the movement of said bed frame between the retracted position within said sofa and the extended position wherein the interconnected sections extend out and over the stationary front rail of said sofa frame in substantially co-planar horizontal relation.

2. The bed frame of claim 1 wherein said front support lever means is pivotally connected to a rear portion of said rails of said body section, and said rear support lever means is pivotally connected to said side rails of said body section at a point rearward of said front support lever means connection.

3. The bed frame of claim 1 wherein the facing ends of the pivotally interconnected side rails of said head, body, intermediate and foot sections are spaced apart when said bed frame is in its extended position.

4. The bed frame of claim 1 wherein said rear support lever means comprises a lower rear support lever connected at its base to said movable pivot and an upper rear support lever one end of which is pivotally connected to the upper end of said lower rear support lever and one end of which is pivotally connected to said body section of said bed frame.

5. The bed frame of claim 1 further comprising spring means adapted to be attached at one end to said support means and at the other end to said front support lever means, said spring means being operable to assist in rotating said front support lever means about said front fixed pivot when said bed frame is moved from its retracted position to its extended position.

6. The bed frame of claim 5 wherein said support fixture further comprises a plurality of attachment positions for said spring means such that the tension on said spring means may be varied.

7. The bed frame of claim 1 wherein said rear support lever means slides between a forward position when said bed frame is in its extended position and a rearward position when said frame is in its retracted position.

8. The bed frame of claim 1 or 7 wherein said movable pivot slides in a generally horizontal slot in said support means.

9. In a foldable sofa bed fixture adapted to be mounted upon a sofa frame having a stationary front rail, said fixture comprising a plurality of pivotally interconnected head, body, intermediate and foot bed frame sections extendable to form a bed and foldable to form a sofa seat, the improvement comprising a support fixture for mounting said sofa bed fixture to said sofa frame, said support fixture comprising:

a fixed anchor plate adapted to be attached to said sofa frame and having a fixed front pivot and a slot rearwardly of said fixed front pivot, a bed lock plate and means pivotally connecting said bed lock plate to one side of said body section of said frame, a front support lever pivotally attached at one end to said fixed front pivot of said anchor plate and pivotally attached at the opposite end to said bed lock plate, a rear support lever means and means pivotally and slidably connecting one end thereof in said slot in said anchor plate, the other end thereof being pivotally attached to one side of said body section of said frame, said front support lever and said rear support lever means being operable to lift the body section upwardly and forwardly out of the enclosure in said sofa frame and to project it and the sections connected to it upwardly and forwardly over said stationary front rail in moving said sofa bed fixture from its folded position within said sofa frame to its extended position and operable to support the interconnected sections extending out and over the stationary front rail of said sofa frame in a substantially co-planar horizontal relation in the extended position, and control link means extending between said front support lever and said rear support lever means for controlling movement of said rear support lever means and said connecting means as said sofa bed fixture is moved between its extended and its folded positions.

10. The improved support fixture of claim 9 wherein said control like means includes a guide link extending between said front support lever and said means connecting said rear support lever to said anchor plate for controlling the sliding movement of said rear support lever means.

11. The support fixture of claim 9 or 10 wherein:

said rear support lever means comprises a lower rear support lever pivotally and slidably connected at one end in said slot in said anchor plate and an upper rear support lever pivotally connected at one end to the opposite end of said lower rear support lever and at its other end directly to said body section of said bed frame, and said control link means includes a control link extending between said front support lever and said pivotal connection between said upper and lower rear support levers.

12. The support fixture of claim 11 wherein said lower rear support lever means pivots and slides rearwardly when said bed fixture is folded to form a sofa seat and forwardly when said bed fixture is extended to form a bed.

13. The support fixture of claim 9 wherein said slot lies generally horizontally.

14. The support fixture of claim 9 wherein the facing ends of the interconnected head, body, intermediate and foot bed frame sections are spaced apart when said fixture is extended to form a bed.

15. The support fixture of claim 11 wherein said control link means includes an actuating arm pivotally connected between said upper rear support lever and the pivotal connection of said front support lever to said bed lock plate.

16. A foldable sofa bed fixture adapted to be mounted upon a sofa frame having a stationary front rail, said fixture comprising a plurality of pivotally interconnected head, body, intermediate and foot bed frame sections, said bed frame sections each including a pair of opposed side rails and being extendable to form a bed and foldable to form a sofa seat, said bed frame being supported by a pair of foldable legs intermediate the head end and foot end of said bed frame, a pair of foldable legs at the foot end of said bed frame, and a support fixture pivotally attached to the rear end of said body section, said support fixture comprising:

support means affixable to the side frame members of said sofa and having a fixed front pivot and rearwardly thereof a slot, front support lever means pivotally connected between said fixed front pivot and said body section of said bed frame, rear support lever means pivotally connected at one end to said body section of said bed frame and having at the other end thereof a pin slidable in said slot and pivotally connecting said rear support lever means to said support means, pivoted linkage means operable to automatically retract said legs into folded relation to said frame sections when the frame sections are folded into a sofa seat and operable automatically to extend said legs when the frame sections are extended into a bed position, said front and rear support lever means being operable to guide the movement of said body section of said frame and, as a result, the movement of the sections interconnected therewith between a fully folded position within said sofa and an extended position wherein the interconnected sections extend out and over the stationary front rail of said sofa frame in substantially co-planar horizontal relation.

17. The sofa bed fixture of claim 16 wherein the facing ends of said interconnected bed frame sections are spaced apart when said bed frame is in its extended position and wherein said bed frame includes support means to support at least some of said bed sections in coplanar relationship in said extended position.

18. The sofa bed fixture of claim 17 wherein said support means makes a pivotal connection with said bed frame at one end and a pin and slot connection with said bed frame at the other end and has a flange portion operative to engage said side rails in the extended position of said sofa bed fixture.

19. The sofa bed fixture of claim 17 or 18 wherein said support means comprises a first locking strap extending between said head section and said body section to assure coplanar relationship therebetween in the extended position of said sofa bed fixture, and a second locking strap extending between said body section and said intermediate section to assure coplanar relationship therebetween in said extended position of said sofa bed fixture.

20. The sofa bed fixture of claim 16 wherein said pivoted linkage means operable to automatically retract said legs comprises a first leg actuating arm, a second leg actuating arm, a compression arm, and bell crank means pivoted to the side of said bed frame having one arm thereof pivotally connected to said first leg actuating arm and the other arm thereof pivotally connected to said compression arm, said compression arm making a lost motion connection with said second leg actuating arm, said first leg actuating arm being operable on rotation of said bell crank means to automatically retract said front legs into folded relation to said foot bed frame section when said foot section is raised to a generally vertical position.

21. The sofa bed fixture of claim 20 wherein said lost motion connection comprises a pin and slot connection with said pin engaging the rearward end of said slot to prevent raising of said foot section when said foot section has been folded into overlying relationship with said body section and said body section has been inclined to the horizontal.

22. The sofa bed fixture of claim 20 wherein said bell crank means is connected to the outside of the rearward ends of the side rails of said intermediate section.

23. The sofa bed fixture of claim 20 wherein said fixture further comprises a stud protruding from said foot section and a bell crank actuating arm extending between said first leg actuating arm and said bell crank means, said stud being operative to engage said bell crank actuating arm in the extended position of said fixture.

24. The bed frame of claim 20 wherein said second leg actuating arm is pivotally connected between said center legs and a bed lock plate pivotally connected to one side of said body section, said bed lock plate and second leg actuating arm being operable to retract said center legs into folded relation to said body section when the frame sections are folded into a sofa seat and operable automatically to extend said center legs when said frame sections are extended into a bed position.

25. The sofa bed fixture of claim 16 wherein said head section is movable sequentially between an inclined position with respect to said body section and a substantially coplanar horizontal position with respect to said body section and wherein said fixture includes means to releasably lock said head section in said inclined position.

26. The sofa bed fixture of claim 25 wherein said fixture further comprises a TV slotted link pivotally connected at one end with said head section, a TV control link pivotally connected at one end to a bed lock plate in turn pivotally connected to the side of said body section of said bed fixture, and a TV support link pivotally connecting the respective opposite ends of said TV slotted link and TV control link, said links being operable to move said head section from a coplanar relation with said body section in the extended position of said fixture to a generally perpendicular relation thereto in the folded position of said fixture.

27. In a foldable sofa sleeper fixture adapted to be mounted upon a sofa frame having back and side members and a front rail which define a rectangular storage enclosure, said fixture comprising a plurality of pivotally interconnected head, body, intermediate and foot sections, said sections each including a pair of opposed side rails, and means for supporting said fixture for movement between: (1) a retracted position in which the bed frame is contained within said storage enclosure behind said front rail substantially entirely below the plane of the top surface of said front rail to form a sofa seat, and (2) an extended position in which said bed frame lies above and extends forwardly over said front rail to form a bed, the improvement comprising:

the facing ends of the pivotally interconnected side rails of said head, body, intermediate and foot sections being spaced apart when said fixture is in its extended position to prevent the pinching of bedclothes between said facing ends.

28. The sofa-sleeper fixture of claim 27 further comprising means for supporting at least some of said pivotally interconnected sections in coplanar relationship in said extended position of said fixture.

29. The sofa-sleeper fixture of claim 28 where said support means make a pivotal connection with the side rail of one section and a pin and slot connection with the side rail of an adjacent section and has a flange portion operative to engage said side rails in said extended position of said fixture.

30. The sofa-sleeper fixture of claim 29 including first support means extending between said head and body sections and second support means extending between said body and intermediate sections.

31. A foldable sofa-sleeper bed frame adapted to be mounted on a sofa frame having a back and side members and a stationary front rail which define a rectangular storage enclosure, said bed frame comprising a plurality of articulated head, main body, intermediate and foot sections, said bed frame sections each including a pair of opposed side rails, and a fixture supporting said bed frame for movement between (1) a retracted position in which the bed frame is contained within said storage enclosure behind said stationary front rail substantially entirely below the plane of the top surface of said front rail to form a sofa seat, and (2) an extended position in which said bed frame lies above and extends forwardly over said stationary front rail to form a bed, said support fixture comprising:

an anchor plate affixable to the side frame members of said sofa and having a fixed front pivot, front support lever means pivotally connected between said fixed front pivot and said main body section side rail, rear support lever means pivotally connected to said main body section side rail rearwardly of the connection of said front support lever means to said main body section side rail, means for effecting a movable pivotal connection between said rear support lever means and said anchor plate said front and rear support lever means being operable to lift the main body section angle upwardly and forwardly out of the enclosure in said sofa frame and to project it and the sections articulated to it upwardly and forwardly over said stationary front rail and, in the extended position, to support the rear end of said main body section angle, and control link means for controlling the movement of the pivotal connection between said rear support lever means and said anchor plate to control the position of said pivotal connection as the frame moves between its retracted and its extended positions and to control pivotal movement of said rear support lever means about said pivotal connection.

* * * * *

UNITED STATES PATENT AND TRADEMARK OFFICE

CERTIFICATE OF CORRECTION

PATENT NO. : 4,253,205

DATED : March 3, 1981

INVENTOR(S) : Aloysius J. Mikos

It is certified that error appears in the above—identified patent and that said Letters Patent is hereby corrected as shown below:

In column 13, line 38, "like" should be --link--.

Signed and Sealed this

*Nineteenth* Day of *May 1981*

[SEAL]

*Attest:*

RENE D. TEGTMEYER

*Attesting Officer*

*Acting Commissioner of Patents and Trademarks*